US006712948B1

(12) United States Patent
Naruskevicius et al.

(10) Patent No.: US 6,712,948 B1
(45) Date of Patent: Mar. 30, 2004

(54) PROCESS FOR METALLIZING A PLASTIC SURFACE

(75) Inventors: Leonas Naruskevicius, Vilnuis (LT); Grigorijus Rozovskis, Vilnius (LT); Jonas Vinkevicius, Vilnius (LT); Mykolas Baranauskas, Vilnius (LT); Andreas Mobius, Kaarst (DE); Peter Pies, Cologne (DE)

(73) Assignee: Enthone Inc., West Haven, CT (US)

( * ) Notice: Subject to any disclaimer, the term of this patent is extended or adjusted under 35 U.S.C. 154(b) by 0 days.

(21) Appl. No.: 09/831,008

(22) PCT Filed: Nov. 5, 1999

(86) PCT No.: PCT/US99/26066

§ 371 (c)(1),
(2), (4) Date: May 3, 2001

(87) PCT Pub. No.: WO00/29646

PCT Pub. Date: May 25, 2000

(30) Foreign Application Priority Data

| | | |
|---|---|---|
| Nov. 13, 1998 | (LT) | 98-161 |
| Feb. 4, 1999 | (DE) | 199 04 665 |
| Aug. 13, 1999 | (EP) | 99115967 |

(51) Int. Cl.[7] ..... C25D 5/56

(52) U.S. Cl. ..... 205/164; 205/159; 205/166; 427/304; 427/306

(58) Field of Search ..... 205/159, 164, 205/166; 427/304, 305, 306

(56) References Cited

U.S. PATENT DOCUMENTS

| | | | | |
|---|---|---|---|---|
| 3,620,834 A | * | 11/1971 | Duffy | 117/213 |
| 4,810,333 A | | 3/1989 | Gulla et al. | |
| 4,917,761 A | | 4/1990 | Keep | |
| 4,919,768 A | | 4/1990 | Bladon | |
| 4,952,286 A | * | 8/1990 | Bladon et al. | 204/15 |
| 5,110,633 A | | 5/1992 | Cassat et al. | |
| 5,192,590 A | | 3/1993 | Sherman | |
| 5,238,550 A | | 8/1993 | Burress | |
| 5,762,777 A | * | 6/1998 | Yang et al. | 205/158 |

* cited by examiner

*Primary Examiner*—Roy King
*Assistant Examiner*—William T. Leader
(74) *Attorney, Agent, or Firm*—Senniger, Powers, Leavitt & Roedel

(57) ABSTRACT

A process for the metallization of a plastic surface, whereby the following process steps are performed in sequence, one after another. The plastic surface is subjected to an etching treatment under mild etching conditions. Subsequently, the plastic surface is treated with a metal salt solution, containing at least one salt from the following group: cobalt salt, silver salt, tin salt, and lead salt. The plastic surface is treated with a sulfide solution. Finally, the plastic surface is metallized in a metallizing bath.

3 Claims, No Drawings

PROCESS FOR METALLIZING A PLASTIC SURFACE

The invention concerns a process for the metallizing of a plastic surface. Within the scope of the process, in accordance with the invention, the plastic surface of a plastic article or the plastic surfaces of several plastic articles are metallized.

On the one hand, metallized plastics are used for decorative purposes, for example in the sanitary facilities field or in the manufacture of automobiles. On the other hand, metallization of plastics also occurs in connection with the surface treatment of electronic components for the purpose of electronic shielding. Especially the surfaces of plastics, such as acrylnitrile-butadiene-styrene (ABS) and possibly ABS-Polycarbonate blends are metallized for decorative purposes.

In an already known process in practice, the plastic surface is first roughened by strong etching, for example with chromic acid or chrome-hydrochloric acid. By surface roughening is meant especially that, due to the etching process, micro-caverns are created in the plastic surface. These micro-caverns, in general, have a size on the order of 0.1 to 10 $\mu$m. Especially, these micro-caverns show a depth (i.e. an extent from the plastic surface toward the interior) in the range of 0.1 to 10 $\mu$m. The etching takes place at relatively high temperatures and, as a rule, for relatively extended periods. The concentration of an oxidizer added to the etching solution normally is relatively high. The roughening of the plastic surface has the purpose of allowing the subsequently to be applied activating layer and/or metal layer to almost hook into the roughened plastic surface. The adhesion of a metal layer to the roughened plastic surface is achieved almost in the manner of the snap fastener principle in this known process. After the etching or roughening of the plastic surface, the surface first is activated with colloidal palladium or ionogene palladium. This activation, in the case of the colloidal process, is followed by a removal of a protective tin colloid or, in the case of the ionogene process, a reduction to the elemental palladium. Subsequently, copper or nickel is chemically deposited on the plastic surface as a conducting layer. Following this, galvanizing or metallizing, respectively, takes place. In practice, this direct metallizing of the plastic surface works only for certain plastics. If sufficient roughening of the plastic, or the formation of suitable micro-caverns, respectively, is not possible by etching the plastic surface, a functionally secure adherence of the metal layer to the plastic surface is not guaranteed. Therefore, in the case of the known process, especially the number of plastics capable of being coated is greatly limited. The direct metallization in accordance with this known process generally only functions without problems with ABS plastic parts. In the case of ABS-Polycarbonate blends and polypropylene, metallization is only possible under certain working conditions. In view of this, this known process is capable of improvement.

In the case of another known process ("New methods of electroless plating and direct electroplating of plastics", A. Vaskelis et al., Institute of Chemistry, A Gostauto 9, 2600 Vilnius, Lithuania, paper to be presented the INTERFINISH 96 WORLD CONGRESS, International Convention Centre, Birmingham, England, Sep. 10–12, 1996), the plastic surface likewise is roughened by relatively heavy or strong etching, respectively. Here also micro-caverns are created in the plastic surface by etching in which the metal layer to be applied is mechanically anchored or hooked into. Also, the etching occurs at elevated temperatures in this process. The etching solution generally has a high concentration of an oxidizer. The plastic surface, pre-treated in this manner, subsequently is treated with a copper salt solution, and afterward it is treated with a second solution, containing sulfide ions or polysulfide ions. In this manner, an electrically conducting layer of non-stochiomeric copper sulfide is created on the plastic surface. The initial step of this known process is followed by the treatment of the plastic surface with both of the cited solutions at room temperature for a duration of maximally 1 minute. Even with this first step, only certain plastics can be metallized in a somewhat functionally secure and satisfactory manner. After a second step of this known process, the treatment with both of the cited solutions takes place at a higher temperature of 70 to 90° C., and for a longer period of 5 to 15 minutes. With this working process it is intended that both sulfur and also copper ions penetrate the plastic surface into the plastic, and that non-stoichiometric copper sulfide is also generated under the plastic surface. In this manner, especially good adhesion of the subsequently applied metal layer is to be achieved. However, the penetration described takes place only in a very incomplete manner, and thus the adhesion of the metal layer also leaves something to be desired. In addition, also with this process only certain plastics can be metallized in a satisfactory manner.

In practice, there further are several processes known whereby after the etching of the plastic surface and the formation of micro-caverns, the plastic surface is treated with a copper salt solution. Subsequently, a treatment with a sulfide solution is applied. All these processes are characterized by the disadvantage that in order to create a somewhat satisfactory metal layer, the process steps mentioned must be repeated several times in sequence. It is understood that this is complex and expensive.

In contrast, the invention is based on the technical problem to describe a process of the type mentioned in the beginning by which, in a less complex manner, a large variety of plastics can be metallized in a functionally secure and reproducible manner, whereby they are provided with a metal layer which meets all requirements.

To solve this technical problem, the invention describes a process for metallizing a plastic surface, whereby the following process steps are performed in sequence:

1.1) The plastic surface is subjected to etching under mild conditions.

1.2) Subsequently, the plastic surface is treated with a metal salt solution which comprises at least one salt of the group "Cobalt salt, silver salt, tin salt, lead salt".

1.3) The plastic surface is treated with a sulfide solution.

1.4) Finally, the plastic surface is metallized in a metallizing bath.

Additional process steps, especially rinsing steps, may be interspersed with the process steps which are the subject of the invention.

The mild etching referred to in the invention means especially that the "etching", or the treatment of the plastic surface, respectively, with a etching solution occurs at low temperatures and/or within a shorter time period at low concentration of the etching solution. As a matter of principle, mild etching conditions can be realized already when one of the preceding three conditions is met. The low temperature referred to in the invention means a maximum temperature of 40° C. When the mild etching conditions are created by a low temperature, this is usefully a maximum of 30° C., with a temperature of between 15° C. and 25° C. being preferred. With the low temperatures mentioned above, the pre-treatment with the etching solution takes place especially over a time period of 3 to 15 minutes, preferably 5 to 15 minutes and even more preferred 5 to 10 minutes. The invention claims that the treatment period is the shorter the higher the temperature. However, mild etching conditions can be also achieved at temperatures in excess of 40° C. if the treatment period selected is appropriately short. According to one version of the invention, the etching treatment takes place at temperatures of 40° C. to 95° C., preferably 50° C. to 70° C., for a treatment period of 15 seconds to 5 minutes, preferably 0.5 to 3 minutes. Here also, the invention claims that the treatment period is the shorter the higher the process temperature. In practical terms, the process temperature and/or process time is selected in accordance with the type of the etching solution employed.

Mild etching as specified in the invention also means that, contrary to the known processes referred to above, a roughening of the plastic surface, or the creation of micro-caverns in the plastic surface, respectively, does not occur. The micro-caverns created with etching according to the state of the art or the hollow spaces, respectively, normally have a diameter or depth, respectively, in the size range of 0.1 to 10 $\mu$m. The invention, however, envisions that the etching conditions are adjusted so that only small openings or pores, respectively, are created in the plastic surface which have a diameter and especially a depth of <0.09 $\mu$m, with <0.05 $\mu$m preferred. In this connection, depth means the extent of the openings/gateways from the plastic surface into the plastic interior. Thus, no etching in the classical sense takes place here as is the case with the known processes. The invention envisions that by creating small openings or pores, respectively, the plastic surface is opened for the diffusion of the metal ions of the metal salt solution. In other words, the plastic surface is transformed into something membrane-like, or a quasi diffusion membrane is created in the plastic surface, respectively. Mild etching conditions within the scope of the invention also mean that the etching conditions are applied with the intention that only the mentioned small pores are created in the plastic surface and that micro-caverns or interior hollows, respectively, in the plastic surface do not occur. In practical terms, diffusion openings or diffusion channels are created in the area of the plastic surface which have a depth of <0.09 $\mu$m, preferably <0.05 $\mu$m.

The etching treatment envisioned by the invention can be realized with a etching solution and/or basically also by a plasma treatment or by plasma etching, respectively.

Preferably, a etching solution used for etching contains at least one oxidizer. Mild etching within the scope of the invention also means that an oxidizer is used in a low concentration. Permanganate and/or peroxodisulfate and/or periodate and/or peroxide can be used as oxidizers. In accordance with one type of process, etching is by an acid etching solution which contains at least one oxidizer. Preferably, a aqueous etching solution is used which contains permanganate and phosphoric acid ($H_3PO_4$) and/or sulfuric acid. In practical terms, potassium permanganate is used as the permanganate. Very much preferred is the use of an acid etching solution which only contains phosphoric acid or principally phosphoric acid and only a little sulfuric acid. According to another type of application of the invention, etching treatment is by a basic aqueous solution, containing permanganate. Here also potassium permanganate is used by preference. In practical terms, the basic aqueous solution contains lye. The invention envisions that the type of etching solution used depends on the type of plastic to be treated.—The preferred concentration of the oxidizer in the etching solution is 0.05 to 0.6 mol/l. In practical terms, the etching solution contains 0.05 to 0.6 mol/l permanganate or persulfate. The invention also envisions that the etching solution contains 0.1 to 0.5 mol/l periodate or hydrogen peroxide. As already stated above, permanganate is very much preferred for the etching solution. The preferred permanganate proportion is 1 g/l up to the solubility limit of the permanganate, preferably potassium permanganate. In practical terms, a permanganate solution contains 2 to 15 g/l permanganate, preferably 2 to 15 g/l potassium permanganate. The invention envisions that the permanganate solution contain a wetting agent.—As already stated above, mild etching can also be achieved by the use of a dilute aqueous persulfate solution or periodite solution or a dilute aqueous peroxide solution. Preferably, the mild etching treatment with a etching solution is carried out while agitating the solution.—Subsequent to the mild etching, the plastic surface is rinsed, for example 1 to 3 minutes in water. In accordance with a very much preferred type of application of the invention, the treatment with the metal salt solution according to 1.2) is carried out at a temperature of maximally 30° C., preferably at a temperature between 15 and 25° C. Thus, it lies within the scope of the invention to also carry out the treatment with the metal salt solution in the range of room temperature. In practice, the treatment with the metal salt solution is performed without agitation. The preferred treatment time is 30 seconds to 15 minutes, preferably 3 to 12 minutes.—Preferably, a metal salt solution is used which has a pH value of between 7.5 and 12.5, preferably adjusted to between 8 and 12. In accordance with a preferred type of application of the invention, a metal salt solution is used which contains ammonia and/or at least one amine. The above-mentioned pH value adjustment can be effected with the help of ammonia, and in this case, within the scope of the invention, an alkaline metal salt solution is used. Basically, however, it is also within the scope of the invention to use a metal salt solution which contains one or more amines. For example, the metal salt solution may contain monoethanolamine and/or triethanolamine. Treatment with the metal salt solution, within the scope of the invention, means especially the immersion of the plastic surface into the metal salt solution.

According to a very much preferred type of application, which is especially meaningful within the scope of the invention, a cobalt salt solution is used as the metal salt solution. Preferably, the cobalt salt solution contains 0.1 to 15 g/l Co(II) salt, preferably 5 to 12 g/l Co(II) salt. In practical terms the cobalt (II) solution contains cobalt (II) sulfate and/or cobalt (II) chloride. Preferably, the cobalt (II) solution contains 0.1 to 15 g/l $CoSO_4.7H_2O$; very much preferred is 1 to 10 g/l $CoSO_4.7H_2O$.—According to a very much preferred type of application within the scope of the invention, a metal salt solution used is especially a cobalt salt solution, containing at least one oxidizer. The oxidizer may be hydrogen peroxide, for example. The oxidizer may also be made available by blowing air into the metal salt solution. If, in accordance with the preferred type of application of the invention, the metal salt solution is a cobalt (II) salt solution, the oxidizer is preferred to be used with the proviso that at least part of the cobalt (II) is oxidized into cobalt (III).—Subsequent to the treatment with the metal salt solution, the plastic surface is as rinsed as required.

In accordance with the preferred type of application of the invention, the plastic surface is immersed into a aqueous alkaline solution between the process steps 1.2) and 1.3).

The treatment or immersion time is preferably 10 seconds to 3 minutes, 0.5 to 2 minutes is very much preferred.

Preferably, a bath temperature of maximally 30° C. is used, 15 to 25° C. is preferred. For practical purposes, the aqueous alkaline solution has a pH value of 9 to 14. The immersion in the aqueous alkaline solution is preferably in a dilute sodium lye. The scope of the invention includes the use of sodium hydroxide and/or potassium hydroxide and/or sodium carbonate for making the aqueous alkaline solution. It is very much preferred that the aqueous alkaline solution contain 5 to 50 g/l sodium hydroxide or potassium hydroxide. Preferred here is the concentration of sodium hydroxide or potassium hydroxide to be the higher, the higher the metal salt concentration of the metal salt solution. In principle, the plastic surface, instead of a aqueous alkaline solution, may also be treated with a aqueous acid dip solution.—It is within the scope of the invention to rinse with water or distilled water, respectively, subsequent to the immersion treatment.

In accordance with the preferred type of application of the invention, the plastic surface is treated with an alkaline solution of an alkali metal sulfide according to process step 1.3). An ammonium sulfide may also be used. The sulfide, for example, may be a monosulfide, disulfide, tetrasulfide or a polysulfide. According to the preferred procedure an alkali metal sulfide ($M_2S$, M=alkali metal) is used, for practical purposes sodium sulfide ($Na_2S$). The concentration of the alkali metal monosulfide, preferably the sodium sulfide, is preferred to be 0.5 to 10 g/l; very much preferred is 2 to 8 g/l. For practical purposes, the alkali solution of the alkali metal sulfide contains 5 to 25 g/l of sodium hydroxide, for example 10 g/l sodium hydroxide. The treatment with the sulfide solution preferably takes place over a time period of 15 seconds to 5 minutes; very much preferred is 30 seconds to 2 minutes.—The treatment with the sulfide solution in accordance with process step 1.3) is carried out preferably at a maximum temperature of 30° C.; a temperature of between 15 and 25° C. is preferred. —Subsequent to the treatment with the sulfide solution rinsing as required takes place, for example 1 to 3 minutes with cold water.

It is within the scope of the invention that the metal salt solution, preferably a cobalt salt solution and/or the sulfide solution, has added a complex builder for stabilizing of the affected solution. Thus, the metal salt solution may at least partially contain the metal in the form of a metal complex. It is further within the scope of the invention that the metal salt solution and/or the sulfide solution have a wetting agent added so that improved wetting of the plastic surface results.

Within the scope of the invention, a sulfide solution can be used which contains at least one substance from the group "Alcohol, diol, polyol, ployalkanglycol, ployalkenglycol, gel/sol-building substance, such as silicic acid gel or aluminum oxide gel". It is within the scope of the invention to use mixtures of these substances in the sulfide solution.—Within the scope of the invention, a metal salt solution, preferably a cobalt salt solution, may also be used which contains at least one substance from the group "Alcohol, diol, polyol, ployalkanglycol, ployalkenglycol, gel/sol-building substance, such as silicic acid gel or aluminum oxide gel". It is within the scope of the invention to use mixtures of these substances in the metal salt solution.

According to the very much preferred type of application of the invention, drying of the plastic surface is carried out between process step 1.3) and process step 1.4). It is within the scope of the invention that the drying is effected by a heat treatment of the plastic surface (with increased temperature). Preferably, the metallizing of the plastic surface occurs only subsequent to the drying. In principle, when applying the process in accordance with the invention, the treatment with the metal salt solution and/or the treatment with the sulfide solution may be repeated. It is within the scope of the invention that in the case of multiple treatment with the sulfide solution, the plastic surface is dried subsequent to any treatment.

After completion of procedure step 1.3), the direct metallization of the plastic surface may proceed. According to a very much preferred procedure which is especially significant within the scope of the invention, the plastic surface is nickel plated in a nickel bath in accordance with procedure step 1.4). To this extent an electrolytic direct metallization can be carried out. Electro-chemical nickel plating preferably takes place in a Watts electrolyte. In practice, the treatment time is 10 to 15 minutes in this connection, and the electrolyte temperature is preferred to be 30 to 40° C. It is within the scope of the invention that for electro-chemical nickel plating an initial current density of 0.3 $A/dm^2$ is used which later is increased to 3 $A/dm^2$. In this manner a nickel layer can be deposited on the plastic surface by electrolytic metallizing.

First, the invention is based on the knowledge that the plastic surface when etched as described in the invention is manipulated in such a manner that ultimately, surprisingly, a very tight adherence of the applied metal layer to the plastic surface is achieved. These tightly adhering metal layers show a high temperature cycling resistance and, accordingly, survive all the customary temperature cycling shocks. Further, the invention is based on the knowledge that using the process described in the invention conditions can be created within a relatively short time which are optimally suited for the subsequent application of the metal or the nickel layer, respectively. Although it is basic to the scope of the invention that the process steps are repeated and especially to repeat steps 1.2) and 1.3), surprisingly, optimal results are also achievable without the repetition of these process steps. Within the scope of the invention, with little investment and little material consumption, high-quality metal layers, especially nickel layers, are obtained on plastic surfaces. Neither does it require complex equipment, and traditional or commonly available fixtures can be used. In order to apply the process which is the subject of the invention, it is of advantage that only limited space is required. In addition, the time involved in applying the process which is the subject of this invention is short, so that also a substantial time savings results when compared with the known processes. Further, the process can be controlled in a functionally secure and simple manner which ultimately affects the quality of the metal layers. It is of special significance within the scope of the invention that by the application of the measures contained in the invention, a surprising variety of plastics can be metallized effectively and in a functionally secure manner. This is especially surprising in view of the fact that only a certain few plastics could be satisfactorily metallized with the processes known heretofore. First, pure ABS can be metallized optimally and without problems using the process which is the subject of the invention. This also applies to ABS/PC blends and especially also to ABS/PC blends with a relatively high PC component (PC=Polycarbonate). Pure PC can also be metallized without problems with the help of the process which is the subject of the invention. Such an effective and functionally secure metallization, surprisingly, is also possible with many other plastics, among others especially also in the case of the following plastics: POM (polyoxymethylene), PEEK (polyetheretherketone), PP (polypropylene). In view of the fact that, in accordance with the invention, etching of the plastic surface at high temperatures is not necessary, energy savings may also be achieved. Since only mild etching conditions are required, the most varied etching solutions can be used in different ways so that the process which is the subject of the invention is not subject to restrictions from this point of view either. Based on the mild etching solutions to be adjusted in accordance with the invention, it is of advantage to dispense with aggressive etching solution components, for example chromic acid.—Due to the fact that preferably the process steps 1.1), 1.2) and 1.3) are carried out at a maximum temperature of 30° C., preferably at a temperature of 15 to 25° C., the process which is the subject of the invention only requires mild conditions over-all which, among others, results in a considerable energy savings. In addition, due to the mild conditions, undesirable side reactions are avoided to a large extent. With the process which is the subject of the invention, a very selective metallization of the plastic surface can be achieved. It should be emphasized that with this procedure the use of racks can be avoided in a functionally secure manner.

In the following, the process is explained on the basis of an example: Depending on the plastic type to be metallized, either an acid or an alkaline etching solution is employed. In accordance with a preferred type of application of the invention, an acid etching solution is used for mild etching, consisting of 100 to 300 ml/l water, 700 to 900 ml/l concentrated phosphoric acid and 3 to 7 g/l potassium permanganate. According to an application example, the acid etching solution consists of 74% by weight of phosphoric acid, 26% by weight of water and 5 g potassium permanganate. According to another type of application of the invention, an alkaline etching solution is used for mild etching which, in practice contains 20 to 40 g/l sodium hydroxide and 5 to 15 g/l potassium permanganate. In accordance with an application example, the aqueous alkaline etching solution consists of 30 g/l sodium hydroxide and 10 g/l potassium permanganate. With the acid etching solution or the alkaline etching solution explained above, etching takes place preferably at room temperature over a period of 10 minutes. Subsequent to the etching treatment, the plastic surface is rinsed as required. —Furthermore, in accordance with the preferred type of application of the invention, an ammoniacal metal salt solution is employed which contains 0.1 to 12 g/l cobalt (II) sulfate, as well as 10 to 50 ml/l 25% ammonia solution. Activation with the cobalt salt solution preferably occurs at room temperature i.e. during a treatment time of 5 to 10 minutes. Subsequent to the activation with the cobalt salt solution, the plastic surface is rinsed with water as required. —For the aqueous alkaline solution into which the part preferably is immersed subsequent to the treatment with the metal salt solution, 10 to 50 g/l sodium hydroxide is dissolved in water. In accordance with an application example, a aqueous alkaline solution with 20 g/l sodium hydroxide is employed. Immersion in the aqueous alkaline solution, in practice, takes place at room temperature and over a treatment time period of 0.5 to 2 minutes.—Preferably, a sulfide solution is used as the alkaline sulfide solution which contains 0.5 to 10 g/l sodium sulfide ($Na_2S$), as well as 5 to 26 g/l sodium hydroxide. According to a preferred application example, an alkaline alkali sulfide solution is employed which contains 5 g/l sodium sulfide ($Na_2S$), as well as 10 g/l sodium hydroxide. Preferably, the sulfide treatment is carried out at room temperature and over a treatment period of 0.5 to 5 minutes. Subsequent to the sulfide treatment, the plastic surface is rinsed with water as required. It is within the scope of the invention that prior to the metallization, especially nickel plating, the plastic surface is dried.

The invention is explained in more detail in the following by means of six examples. The application examples 1 and 2 correspond to the state of the art (comparison examples), while examples 3 to 6 clarify the process which is the subject of the invention. In the application examples 1, 3 and 5 ABS plastic discs with a surface of 50 $cm^2$ were used, while die-pressed products of impact-resistant polystyrol with a surface of 70 $cm^2$ were used for examples 2, 4 and 6.In the following, the notation "M" corresponds to the concentration "mol/l".

APPLICATION EXAMPLE 1

Disks of ABS plastic having a surface of 50 $cm^2$ were pickled for 3 minutes at 70° C. in a etching solution consisting of 4 M $H_2SO_4$ and 3.5 M $CrO_3$. Subsequently, there was a rinse with water. Following this, the plastic articles were treated for 30 seconds in an ammoniacal solution with 0.5 M $CuSO_{4\ .5}\ H_2O$ having a pH value of 9.5 and a temperature of 20° C. The plastic articles then were submerged for 20 seconds in distilled water and, subsequently, for 30 seconds treated with a sulfide solution, containing 0.1 M $Na_2S_2$ and having a temperature of 20° C. After this treatment, the plastic articles were again washed in cold water. Following this was electro-chemical nickel plating. For this, the articles were treated for 15 minutes in a Watts electrolyte, containing 1.2 M $NiSO_4.7H_2O$, 0.2 M $NiCl_2.6H_2O$ and 0.5 M $H_3BO_3$. The initial current was 0.3 A/$dm^2$, and the nickel plating was carried out at 40° C.

APPLICATION EXAMPLE 2

Die-pressed articles of impact-resistant polystyrol having a surface of 70 $cm^2$ were pickled for 30 seconds in a etching solution, containing 15 M $H_2SO_4$ and 0.1 M $CrO_3$ and having a temperature of 20° C. Subsequently, the articles were washed in water and following that were immersed for 30 seconds in an emulsion of 0.2 g/l Xylol and 0.2 g/l Sintanol at 20° C. After the etching treatment, the articles were washed with distilled water. The articles then were treated for 30 seconds with a metal salt solution, containing 0.5 M $CuSO_4.5H_2O$ Monoethanolamin having the pH value adjusted to 9.8, and the temperature of the solution was 20° C. Subsequently, the articles were immersed in distilled water for 20 seconds and following this treated with a sulfide solution for 30 seconds which contained 0.1 M NaS and had a temperature of 20° C. Subsequently, the treatment with the metal salt solution and the following treatment with the sulfide solution as described above was repeated. After this treatment the articles were rinsed in distilled water and electro-chemically nickel plated in a Watts electrolyte as described in Application Example 1.

APPLICATION EXAMPLE 3

The surface of the ABS plastic parts was pickled at room temperature with a solution of 15 M $H_2SO_4$ and 0.05 M $KMnO_4$. After the etching, the articles were rinsed with water and subsequently treated in an amoniacal solution for 10 minutes which contained 0.1 M $CoSO_4$ and had a pH value of 10 as well as a temperature of 20° C. Following this, the articles were treated with water which had been acidified with $H_2SO_4$ to a pH value of 1. Subsequently, for a period of 30 seconds, there was a treatment with a sulfide solution containing 0.01 M $Na_2S_2$. After this treatment, the articles were rinsed with distilled water and then electro-chemically nickel plated with a Watts electrolyte in accordance with Application Example 1.

APPLICATION EXAMPLE 4

The surface of the articles of impact-resistant polystyrol was pickled for a period of 10 minutes and at room temperature with a solution containing 17 M $H_2SO_4$ and 1 M $H_2O_2$. After etching, the articles were rinsed with water and subsequently treated for 10 minutes with a solution containing 0.01 M $CoF_3$ and monoethanolamine up to a pH value of 8 and at a temperature of 20° C. The articles then were immersed for 20 seconds in a aqueous alkaline solution which contained sufficient sodium hydroxide that it had a pH value of 14. Subsequently, they were treated for 30 seconds with a sulfide solution containing 0.05 M $K_2S_4$. The treated articles then were rinsed with distilled water, dried and then nickel plated for 15 minutes in a Watts electrolyte in accordance with Application Example 1.

APPLICATION EXAMPLE 5

The surfaces of the ABS plastic articles were pickled at room temperature with a solution which contained 13 M $H_3PO_4$ and 0.5 $K_2S_2O_9$. After etching, the articles were rinsed with water. Subsequently, they were treated for 10 minutes in a solution containing 0.25 M $CoSO_4$ and triethanolamine up to a pH value of 9 at 20° C. Thereafter, the articles were immersed in a aqueous alkaline solution which had been set to a pH value of 9 with sodium carbonate. Subsequently, they were treated for 30 seconds in a sulfide solution, containing 0.02 $K_2S_3$. After the treatment, the plastic articles were rinsed with distilled water, dried and subsequently, over a time period of 15 minutes, electrochemically nickel plated, using a Watts electrolyte in accordance with Application Example 1.

APPLICATION EXAMPLE 6

The surface of the articles of impact-resistant polystyrol was pickled at room temperature with a solution which contained 17 M $H_2SO_4$ and 0.5 M $KIO_4$. After etching, the articles were rinsed with water and subsequently were treated with a solution, containing 0.01 M $CoF_3$ which had been adjusted to a pH value of 12 with ammonia and which had a temperature of 20° C. The articles then were immersed for 20 seconds in an acidic solution which had been adjusted to a pH value of 5 with the help of acetic acid. Subsequently, the articles were treated for 30 seconds in a sulfide solution which contained 0.01 M $Na_2S$. After this treatment, the articles were rinsed with distilled water, dried and subsequently electro-chemically nickel plated for 15 minutes, using a Watts electrolyte in accordance with Application Example 1.

The data relating to the processes carried out in accordance with the Application Examples 1 to 6, as well as the properties of the resulting metal layers are summarized in the following table.

| Application example | 1 | 2 | 3 | 4 | 5 | 6 |
|---|---|---|---|---|---|---|
| Plastic | ABS | impact-resistant polystyrol | ABS | impact-resistant polystyrol | ABS | impact-resistant polystyrol |
| Etching solution | $H_2SO_4 + H_2O + CrO_3$ | | $H_2SO_4 + H_2O + KMnO_4$ | $H_2SO_4 + H_2O$ $H_2O_2$ | $H_3PO_4 + H_2O$ $K_2S_2O_8$ | $H_2SO_4 + H_2O + KIO_4$ |
| Metal salt solution: | | | | | | |
| Metal | Cu | Cu | Co | Co | Co | Co |
| Metal ion concentration (M) | .5 | .5 | .01 | .01 | .25 | .01 |
| pH value | 9.5 | 9.8 | 10.0 | 8.0 | 9.0 | 12.0 |
| Sulfide | $Na_2S_2$ | $Na_2S$ | $Na_2S_2$ | $K_2S_4$ | $K_2S_3$ | $Na_2S$ |
| Sulfide concentration in the sulfide concentration (M) | .01 | .1 | .01 | .05 | .02 | .1 |
| Number of treatments with the metal salt solution and the sulfide solution | 1 | 2 | 1 | 1 | 1 | 1 |
| Covering of the plastic surface by the nickel layer: completely (+) or incompletely (–) | – | – | + | + | + | + |
| Spreading velocity of the galvanic nickel coating, starting at the contact (cm/min) | 0 | .3–.4 | 3–4 | 4–5 | 2–3 | 3–4 |
| Evenness of the nickel coating | — | uneven | even | even | even | even |
| Plastic metallizing: selective (+) not selective (–) | – | – | + | + | + | + |

We claim:

1. A process for metallizing a plastic surface comprising the following process steps which are carried out sequentially one after the other:

subjecting the plastic surface to a etching treatment under mild etching conditions;

subsequently treating the plastic surface with a metal salt solution comprising at least one salt selected from the grout comprising a cobalt salt, a silver salt, a tin salt, and a lead salt, wherein the metal salt solution has a pH from about 7.5 to about 12.5;

treating the plastic surface with a sulfide solution; and finally, metallizing the plastic surface.

2. The process in accordance with claim 1 wherein the metal salt solution has a pH from about 8 to about 12.

3. A process for metallizing a plastic surface comprising the following process steps which are carried out sequentially one after the other:

subjecting the plastic surface to a etching treatment under mild etching conditions;

subsequently treating the plastic surface with a metal salt solution comprising at least one nitrogen-containing compound selected from the group consisting of ammonia and amines and further comprising at least one salt selected from the group comprising a cobalt salt, a silver salt, a tin salt, and a lead salt;

treating the plastic surface with a sulfide solution; and finally, metallizing the plastic surface.

* * * * *